US007204297B2

(12) United States Patent
Rehberg

(10) Patent No.: US 7,204,297 B2
(45) Date of Patent: Apr. 17, 2007

(54) PLATE-TYPE HEAT EXCHANGER WITH DOUBLE-WALLED HEAT TRANSFER PLATES

(75) Inventor: Peter Rehberg, Berlin (DE)

(73) Assignee: GEA WTT GmbH, Norbitz-Wilchwitz (DE)

( * ) Notice: Subject to any disclaimer, the term of this patent is extended or adjusted under 35 U.S.C. 154(b) by 464 days.

(21) Appl. No.: 10/822,318

(22) Filed: Apr. 12, 2004

(65) Prior Publication Data

US 2004/0200607 A1 Oct. 14, 2004

(30) Foreign Application Priority Data

Apr. 14, 2003 (DE) ..... 103 17 263

(51) Int. Cl.
*F28F 3/08* (2006.01)

(52) U.S. Cl. ..... 165/70; 165/167

(58) Field of Classification Search ..... 165/70, 165/166, 167

See application file for complete search history.

(56) References Cited

U.S. PATENT DOCUMENTS

| | | | | |
|---|---|---|---|---|
| 4,976,313 | A * | 12/1990 | Dahlgren et al. | 165/167 |
| 5,178,207 | A * | 1/1993 | Bergqvist et al. | 165/70 |
| 5,291,945 | A | 3/1994 | Blomgren et al. | 165/167 |
| 5,487,424 | A * | 1/1996 | Davison | 165/166 |
| 5,913,361 | A | 6/1999 | Engström et al. | 165/70 |
| 6,305,466 | B1 | 10/2001 | Andersson et al. | 165/140 |
| 6,478,081 | B1 | 11/2002 | Shaw | 165/167 |
| 6,662,862 | B1 * | 12/2003 | Lindholm | 165/166 |
| 6,911,631 | B2 * | 6/2005 | Nilsson et al. | 219/530 |
| 6,973,961 | B2 * | 12/2005 | Rehberg et al. | 165/70 |
| 2003/0102107 | A1 * | 6/2003 | Nilsson et al. | 165/70 |

FOREIGN PATENT DOCUMENTS

| | | |
|---|---|---|
| CN | 1 192 266 A | 2/1998 |
| DE | 36 00 656 C 2 | 7/1987 |
| GB | 647678 | 12/1950 |

OTHER PUBLICATIONS

English translation of the Chinese Office Action dated Jun. 9, 2006.

* cited by examiner

*Primary Examiner*—Allen J. Flanigan
(74) *Attorney, Agent, or Firm*—Merchant & Gould

(57) ABSTRACT

The invention relates to a plate-type heat exchanger comprising a stack of double-walled heat exchanger plates (30–32) which are permanently interconnected and each include two plate members (33, 34) having a central heat transfer portion (35) and an edge portion (36) bent upwardly with respect to the plane of the central heat transfer portion (35), separate flow passage spaces for at least two heat exchange fluids being defined between the double-walled heat exchanger plates (30–32), the two plate members (33, 34) entering into close mutual engagement at least partly in the area of the central heat transfer portion (35) and the upwardly bent edge portion (36) yet permitting heat exchange fluid between the plate members which gets to the upwardly bent edge portions (36) to exit through an aperture between the upwardly bent edge portions (36), the upwardly bent edge portions (36) being formed respectively with an outer edge (33*a*, 34*a*). The respective outer edges (33*a*, 34*a*) of the two plate members (33, 34) of the double-walled heat exchanger plates (30–32) are spaced from each other.

2 Claims, 4 Drawing Sheets

PLATE-TYPE HEAT EXCHANGER WITH DOUBLE-WALLED HEAT TRANSFER PLATES

Figure 1:
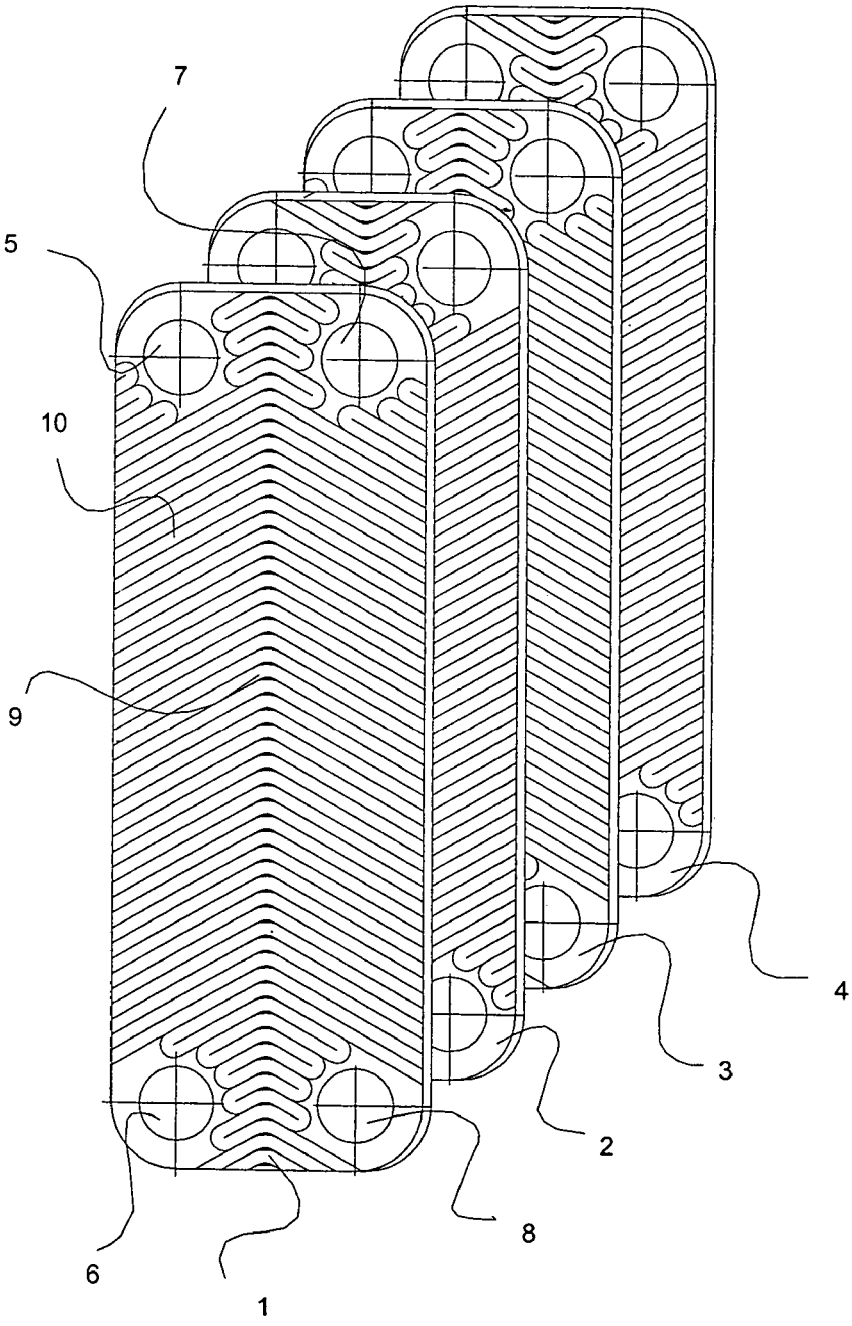

The invention relates to the technical field of plate-type heat ex-changers.

One known structural design of a plate-type heat exchanger comprises a stack of double-walled heat exchanger plates. With this design of plate-type heat exchangers the double-walled heat exchanger plates of the stack are permanently interconnected, especially by soldering. And they each comprise two plate members having a central heat transfer portion and an edge portion which is bent upwardly with respect to the plane of the central heat transfer portion. Separate flow passage spaces for at least two heat exchange fluids are defined between the double-walled heat exchanger plates. The separate flow passage spaces serve to direct the at least two heat exchange fluids past each other at different sides along the central heat transfer portions of the stacked heat exchanger plates for transferring heat. To achieve efficient heat transfer, the two plate members enter into close mutual engagement at least in the area of the central heat transfer portion and at least partly also in the area of the upwardly bent edge portion.

The double-walled design of the heat exchanger plates meets a higher safety standard because it prevents mixing of the at least two heat exchange fluids even in the event of a leak in one of the two plate members, provided there is no leak in the second plate member of the heat exchanger plate.

Should a leak occur in one of the plate members, this damage can be rendered visible to the monitoring and operating staff on the outside of the plate-type heat exchanger because the two plate members of a double-walled heat exchanger plate engage each other in the area of both the central heat transfer portion and the upwardly bent edge portion so that any heat exchange fluid flowing between the two plate members and reaching the upwardly bent edge portions because of a leak in one of the plate members can exit through an aperture which is provided between the upwardly bent edge portions. Hereby, any heat exchange fluid seeping through the leak becomes visible from outside in the edge portion of the heat exchanger plate.

The publication DE 691 06 354 discloses a soldered plate-type heat exchanger having double-walled heat exchanger plates and an outer edge each formed at the upwardly bent edge of the two plate members of the double-walled heat exchanger plates. These outer edges protrude outwardly. The outer edges of the two plate members of each heat exchanger plate are arranged in close engagement with each other, whereas the outer edges of adjacent plate members belonging to two heat exchanger plates disposed one behind the other in the stack, are spaced from each other. This type of edge design is provided so that the undesired entry of soldering material can be. prevented between the plate members which are brought closely together in the respective heat exchanger plate when carrying out the soldering process to connect the heat exchanger plates in the stack of double-walled heat exchanger plates. Otherwise the escape of leaking liquid might be obstructed. The soldering material which is liquid during the soldering process is to be gathered and kept by means of the known edge design between the spaces between the outwardly protruding outer edges of adjacent plate members belonging to two different heat exchanger plates which are disposed behind each other in the stack.

It is the object of the invention to provide an improved plate-type heat exchanger comprising a stack of double-walled heat exchanger plates with which the search for leaks is facilitated.

The invention involves the concept of providing a plate-type heat exchanger comprising a stack of double-walled heat exchanger plates which are permanently interconnected and each include two plate members having a central heat transfer portion and an edge portion bent upwardly with respect to the plane of the central heat transfer portion, separate flow passage spaces for at least two heat exchange fluids being defined between the double-walled heat exchanger plates, the two plate members entering into close mutual engagement at least partly in the area of the central heat transfer portion and the upwardly bent edge portion, yet permitting heat exchange fluid between the plate members which gets to the upwardly bent edge portions to exit through an aperture provided between the upwardly bent edge portions, the upwardly bent edge portions being formed respectively with an outer edge. The outer edges of the two plate members of the double-walled heat exchanger plates are spaced from each other. In this manner, heat exchange fluid which gets between the two plate members because of a leak in one of the two plate members of a double-walled heat exchanger plate becomes visible, when checking the plate-type heat exchanger for leaks, in an area already in which the upwardly bent edge portions of the two plate members closely engage each other. Compared with known plate-type heat exchangers with which the outer edges of the two plate members of the heat exchanger plate are positioned tightly on top of each other, this offers a specific advantage in that a leak becomes visible to monitoring and operating staff from outside even if, caused by the leak, only a minor amount of heat exchange fluid gets between the plate members of the heat exchanger plate and the leak does not cause the heat exchange fluid to exit in the area of the outer edges. When monitoring plate-type heat exchangers, therefore, even minor leakings can be recognized from outside.

A convenient modification of the invention may provide that outer edges of adjacent plate members of two neighboring double-walled heat exchanger plates in the stack are disposed in close mutual engagement. This facilitates stack-type supporting of the plurality of double-walled heat exchanger plates at a given spacing from each other.

A convenient modification of the separate flow passage spaces for the at least two heat exchange fluids is obtained with a preferred embodiment of the invention according to which neighboring double-walled heat exchanger plates are interconnected in fluid-tight fashion along adjacent upwardly bent edge portions.

Figure 2A:
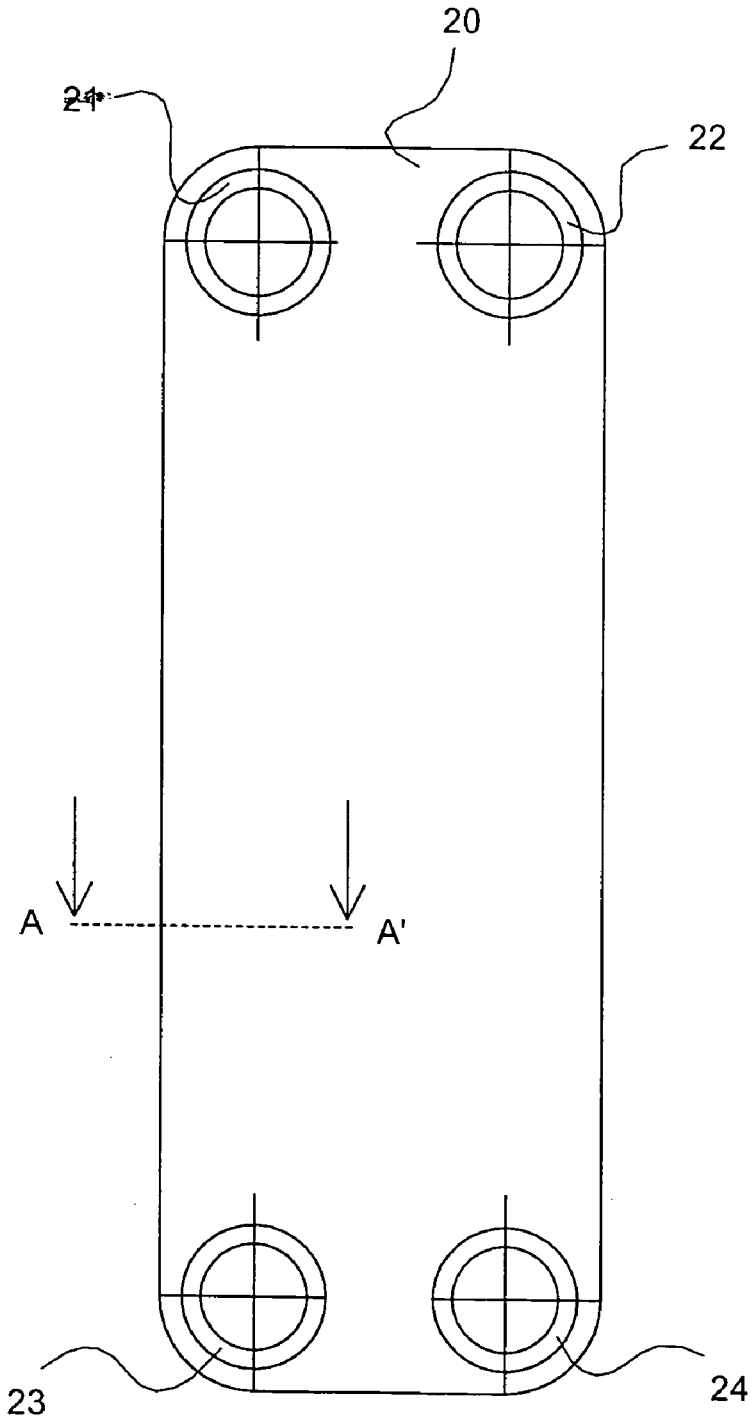
Figure 2B:
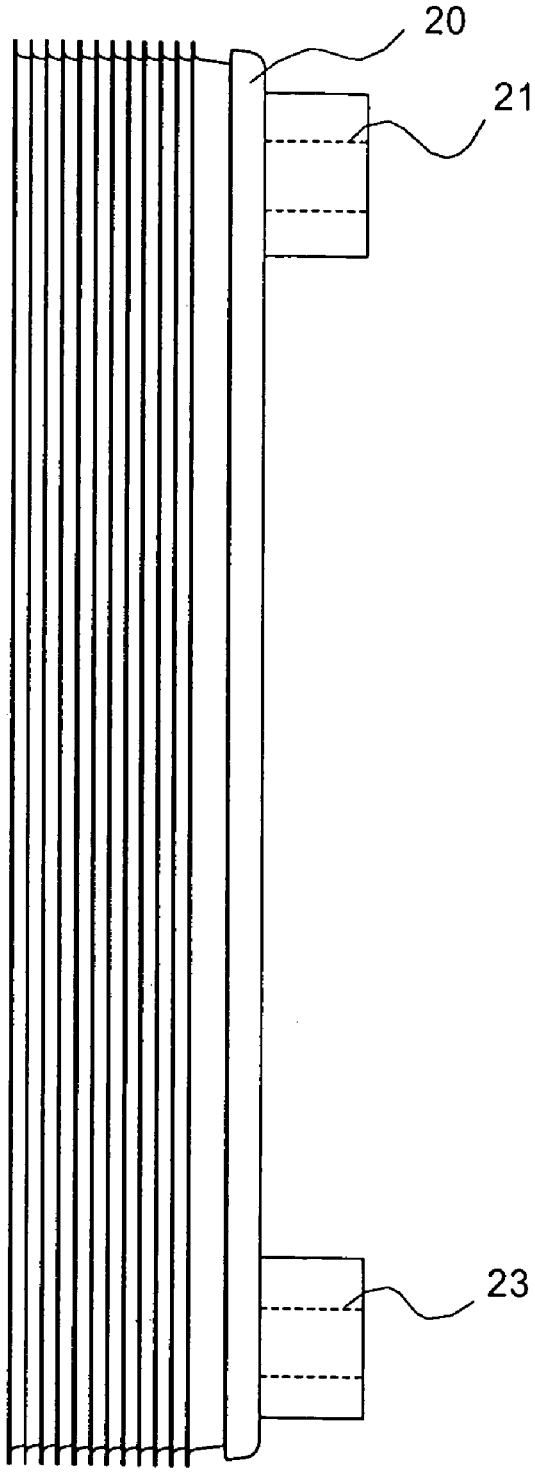
Figure 3:
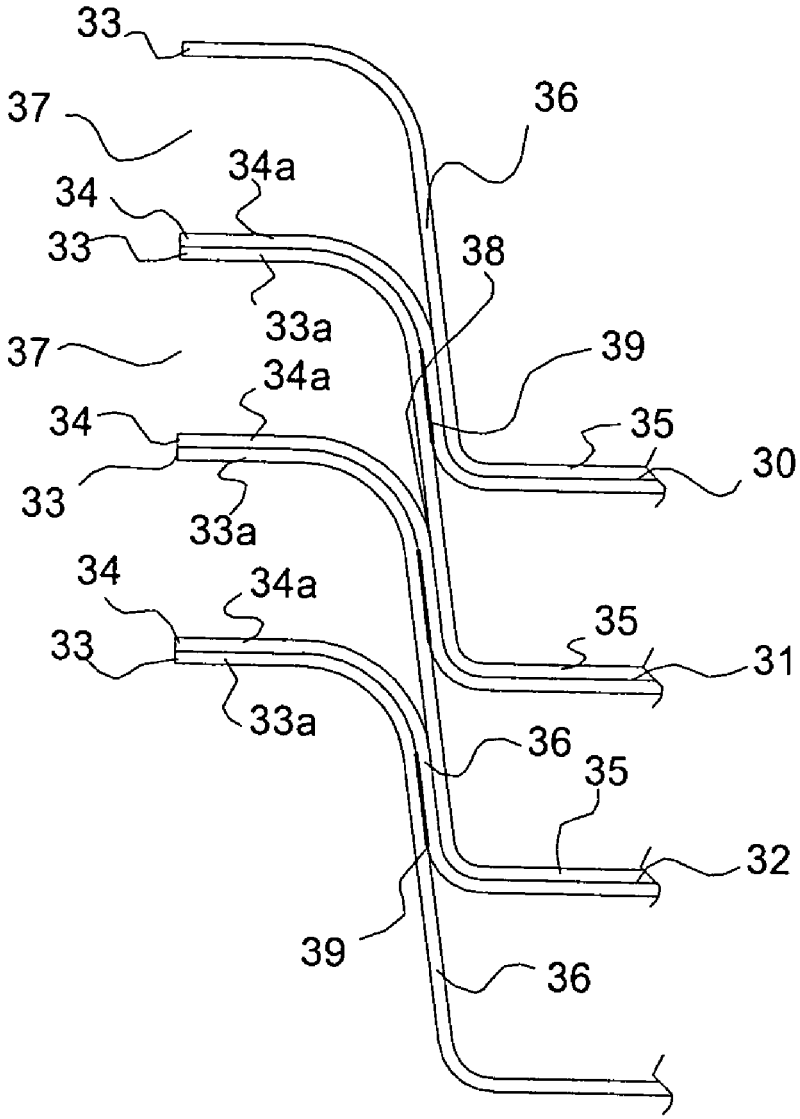

The invention will be described further, by way of example, with reference to the accompanying drawing, in which:

FIG. 1 is a diagrammatic illustration of a plurality of heat exchanger plates;

FIGS. 2*a* and 2*b* show a plate-type heat exchanger in front and side elevations, respectively;

FIG. 3 is a sectional view of an edge portion of the plate-type heat exchanger along line A—A' in FIG. 2*a*.

FIG. 1 diagrammatically shows a plurality of heat exchanger plates 1, 2, 3, 4 disposed one behind the other and each having through bores 5, 6, 7, 8. The heat exchanger plates 1 to 4 each are designed as a double-walled heat exchanger plate consisting of two plate members which enter into close engagement with each other at least in a central heat transfer portion 9 so as to guarantee efficient heat transfer between at least two heat exchange fluid streams flowing through separate flow passage spaces, incorporating the through bores 5 to 8, in a plate-type heat exchanger formed on the basis of the plurality of heat exchanger plates 1 to 4. As described thus far, this is the usual design and the usual functioning of plate-type heat exchangers including double-walled heat exchanger plates. The heat exchanger plates 1 to 4 each have surface contours 10 indicated schematically in FIG. 1. As shown in FIG. 1, alternate heat exchanger plates 1 to 4 are rotated through 180° so as to establish a spacing between successive heat exchanger plates by means of the surface contours 10. In this manner, the separate flow passage spaces for the at least two heat exchange fluids are obtained.

FIGS. 2*a* and 2*b* are diagrammatic presentations, in front and side elevations, respectively, of a plate-type heat exchanger 20 comprising a plurality of stacked double-walled heat exchanger plates of the kind diagrammatically shown in FIG. 1. Inlet and outlet pipe ends 21, 22 and 23, 24 are provided for feeding and discharging the at least two heat exchange fluids.

FIG. 3 is a sectional elevation, along line A—A' in FIG. 2*a*, of part of an edge portion of the plate-type heat exchanger 20. Of the plurality of double-walled heat exchanger plates of the plate-type heat exchanger 20, FIG. 3 shows heat exchanger plates 30, 31, 32 as examples. They each comprise two plate members 33, 34. The two plate members 33, 34 are in close mutual engagement in a central heat transfer portion 35, and this is continued in an edge portion 36 each which is upwardly bent with respect to the plane of the central heat transfer portion 35.

An outer edge 33*a*, 34*a* each is formed at the upwardly bent edge portion 36 of the two plate members 33, 34 and bent outwardly in the embodiment shown. Adjacent outer edges 33*a*, 34*a* of neighboring heat exchanger plates, such as heat exchanger plates 30 and 31 or heat exchanger plates 31 and 32 are positioned in close contact with each other. On the other hand, there is a spacing 37 between outer edges 33*a*, 34*a* of the respective heat exchanger plates 30, 31, or 32 whereby the outer edges 33*a*, 34*a* are spaced from each other, preferably such that a capillary-breaking distance is established. Any heat exchange fluid getting between the respective plate members 33, 34 through a leak in one of the two plate members of the heat exchanger plates 30, 31, 32 will become visible from outside already in an area 38 between the two plate members 33, 34 and, therefore, be seen by monitoring and operating staff:

Among the heat exchanger plates 30, 31, 32, neighboring ones 30 and 31 or 31 and 32 are connected by soldering material 39 in the area of their respective upwardly bent edge portions 36. By capillary action, the soldering material 39 may get as far as into the end portion 40 between the outer edges 33*a*, 34*a*. A distance between the outer edges 33*a*, 34*a* of neighboring heat exchanger plates likewise may be provided (not shown).

The design described of the area of the outer edges 33*a*, 34*a* may be provided for all of the double-walled heat exchanger plates of a plate-type heat exchanger or for only part thereof.

The features of the invention disclosed in the specification above, in the claims and drawing may be significant for implementing the invention in its various embodiments, both individually or in any combination.

What is claimed is:

1. A plate-type heat exchanger comprising a stack of double-walled heat exchanger plates which are permanently interconnected and each include two plate members having a central heat transfer portion and an edge portion bent upwardly with respect to the plane of the central heat transfer portion, separate flow passage spaces for at least two heat exchange fluids being defined between the double-walled heat exchanger plates, the two plate members entering into close mutual engagement at least partly in the area of the central heat transfer portion and the upwardly bent edge portion yet Permitting heat exchange fluid between the plate members which gets to the upwardly bent edge portions to exit through an aperture between the upwardly bent edge portions, the upwardly bent edge portions being formed respectively with an outer edge, characterized in that the respective outer edges of the two plate members of the double-walled heat exchanger plates are spaced from each other in that outer edges of adjacent plate members of two neighboring double-walled heat exchanger plates in the stack are disposed in close mutual engagement.

2. The plate-type heat exchanger as claim 1, characterized in that neighboring double-walled heat exchanger plates are interconnected in fluid-tight fashion along adjacent upwardly bent edge portions.

* * * * *